US009378720B2

(12) United States Patent
Roebke

(10) Patent No.: US 9,378,720 B2
(45) **Date of Patent: *Jun. 28, 2016**

(54) HANDHELD MUSICAL PRACTICE DEVICE

(71) Applicant: FretLabs LLC, Avon, CO (US)

(72) Inventor: Mark J. Roebke, Avon, CO (US)

(73) Assignee: FRETLABS LLC, Avon, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/612,780

(22) Filed: Feb. 3, 2015

(65) Prior Publication Data

US 2015/0143980 A1 May 28, 2015

Related U.S. Application Data

(63) Continuation of application No. 14/214,308, filed on Mar. 14, 2014, now Pat. No. 8,975,501.

(60) Provisional application No. 61/784,313, filed on Mar. 14, 2013.

(51) Int. Cl.

| | |
|---|---|
| ***G10H 1/18*** | (2006.01) |
| ***G10H 3/18*** | (2006.01) |
| ***G10D 3/06*** | (2006.01) |
| ***G10H 1/055*** | (2006.01) |
| ***G10H 1/34*** | (2006.01) |

(52) U.S. Cl.

CPC .. *G10H 3/18* (2013.01); *G10D 3/06* (2013.01); *G10H 1/0551* (2013.01); *G10H 1/342* (2013.01); *G10H 3/186* (2013.01)

(58) Field of Classification Search

CPC ..... G10H 1/18
USPC ..... 84/615, 653
See application file for complete search history.

(56) References Cited

U.S. PATENT DOCUMENTS 3,694,559 A * 9/1972 Suzuki ..... G10H 1/0558 84/735
3,742,114 A * 6/1973 Barkan ..... G10H 1/342 84/737
4,580,479 A * 4/1986 Bonanno ..... G10H 1/46 34/626
4,630,520 A * 12/1986 Bonanno ..... G10H 1/342 84/647
4,658,690 A * 4/1987 Aitken ..... G10H 1/342 84/267
5,398,585 A * 3/1995 Starr ..... G10H 1/342 84/646
7,728,209 B1 * 6/2010 Arnold ..... G10H 1/383 379/419
7,932,898 B2 * 4/2011 Philipp ..... G06F 3/044 178/18.06
8,242,345 B2 * 8/2012 Elion ..... G10H 1/0066 84/646
8,373,672 B2 * 2/2013 Wallace ..... H03K 17/962 200/600
8,395,040 B1 * 3/2013 Kramer ..... A63J 17/00 84/643
8,614,389 B2 * 12/2013 Wallace ..... G10H 3/00 84/733
2008/0236374 A1 * 10/2008 Kramer ..... G10H 1/0016 84/733
2009/0260508 A1 * 10/2009 Elion ..... G10H 1/0066 84/646
2009/0291756 A1 * 11/2009 McCauley ..... A63F 13/02 463/31
2010/0033426 A1 * 2/2010 Grant ..... A63F 13/06 345/156
2011/0011248 A1 * 1/2011 Elion ..... G10H 1/0066 84/646
2012/0137859 A1 * 6/2012 Degerland ..... G10H 1/342 84/731
2013/0074680 A1 * 3/2013 Elion ..... G10H 1/0066 84/646
2013/0180384 A1 * 7/2013 Van Wagoner ..... G10G 1/02 84/485 R
2013/0313943 A1 * 11/2013 Duncan ..... H02N 1/00 310/309
2014/0060290 A1 * 3/2014 Wallace ..... G10H 3/00 84/733

* cited by examiner

*Primary Examiner* — David Warren
(74) *Attorney, Agent, or Firm* — Faegre Baker Daniels LLP

(57) ABSTRACT

A micro-practicing device emulates a portion of a full size instrument. The micro-practicing device includes a fingerboard with fret wires dividing the fingerboard into frets. In order to emulate the portion of the full size instrument, a length of each fret substantially matches lengths of frets of full size instruments. At the same time, the fingerboard is sized to enable increased portability. The device includes capacitive sensors adapted to detect the longitudinal and transverse positions of the user's fingers on the frets, and to communicate that positional information to a body portion. The body portion transmits the positional information to an external musical module, which converts the positional information into musical tones.

20 Claims, 17 Drawing Sheets

HANDHELD MUSICAL PRACTICE DEVICE

RELATED APPLICATIONS

This application is a continuation of U.S. patent application Ser. No. 14/214,308, filed on Mar. 14, 2014, entitled HANDHELD MUSICAL PRACTICE DEVICE, which claims priority to and the benefit of U.S. Provisional Application No. 61/784,313, filed on Mar. 14, 2013, entitled HANDHELD MUSICAL PRACTICE DEVICE. U.S. patent application Ser. No. 14/214,308 was filed on the same day as U.S. Design Application No. 29/485,095, entitled HANDHELD MUSICAL PRACTICE DEVICE, and incorporated the content of that application by reference in its entirety. The contents of U.S. patent application Ser. No. 14/214,308, U.S. Provisional Application No. 61/784,313, and U.S. Design Application No. 29/485,095 are incorporated by reference in their entireties for all purposes.

TECHNICAL FIELD

Embodiments of the present invention relate generally to musical practice devices and in particular to portable, handheld musical practice devices.

BACKGROUND

Many stringed instruments, such as guitars (both electric and acoustic), use frets on a fingerboard that are separated at specific distances by fret wires. The distance between fret wires (i.e., the length of a fret or the fret spacing) is determined by the scale length of the guitar using a formula sometimes referred to as the rule of 18 or, more accurately, the rule of 17.817154. Because many guitars typically use scale lengths between 24.75 inches and 25.5 inches, the length of each fret on a guitar typically falls within a well-defined range.

Typical musicians must practice for many hours before achieving proficiency. In the case or guitars and other stringed instruments, musicians practice in order to train their hands to the size of the frets and the nature of the strings in order to improve their talents. At the same time, full size instruments are too large for easy portability, which limits when and where a musician can initiate a practice session.

SUMMARY

According to embodiments of the present invention, a hand-held micro-practicing device emulates a portion of a stringed instrument, such as a guitar. The micro-practicing device is sized to increase portability while still proving an authentic emulation of the guitar. As a result, the micro-practicing device can be easily carried by the musician to enable a practice session whenever an opportunity arises. To this end, in some embodiments the micro-practicing device includes a fingerboard whose length is more than three times the width of the fingerboard but less than twenty times the width of the fingerboard. The micro-practicing device also includes a string located over the upper surface of the fingerboard and fret wires placed on the upper surface of the fingerboard to divide the fingerboard into frets. The fret spacing substantially matches the fret spacing of select frets on full size instruments. The micro-practicing device is adapted to wirelessly transmit data regarding the location and position of a user's fingers with respect to the frets to an external module, which translates the locational and positional data into musical tones.

DETAILED DESCRIPTION

Embodiments of the present invention include a micro-practicing device designed to emulate a portion of a musical instrument, such as a guitar. To emulate the portion of the guitar, the micro-practicing device includes authentic components of a guitar, such as a string, a fingerboard, fret wires, a fixed bridge saddle, a nut, and/or a tuning machine, among other components. To increase portability, the dimensions of the micro-practicing device are selected so that the micro-practicing device can be easily carried by the musician. For example, the length of the micro-practicing device may approximate the length of an ordinary pen (e.g., approximately 6 inches). The width of the micro-practicing device may also approximate the width of an ordinary pen (e.g., approximately 0.3-0.5 inches). At the same time, the micro-practicing device creates an authentic practice environment as the fret wires are placed on the fingerboard in specific locations so that the resulting frets have lengths that match the lengths of frets on full-size guitars. As a result, a musician can carry the micro-practicing device, for example, in his or her pocket, and at any given moment can initiate an authentic practice session. While many embodiments discussed below relate to a micro-practicing device that emulates a guitar, other embodiments emulate other stringed instruments (both fretted and non-fretted), such as banjo, ukulele, violin, cello, etc.

In some embodiments, the micro-practicing device includes capacitive circuitry that detects the position (both longitudinal and transverse) of the user's fingers on the frets. The micro-practicing device is configured to transmit the positional information to an external musical module, which converts that positional information into musical tones. The micro-practicing device may use wireless protocols, e.g., Bluetooth LE, to efficiently transport the positional information. The specific configurations and components of the micro-practicing device, according to several embodiments, are discussed below in greater detail.

Figure 1:
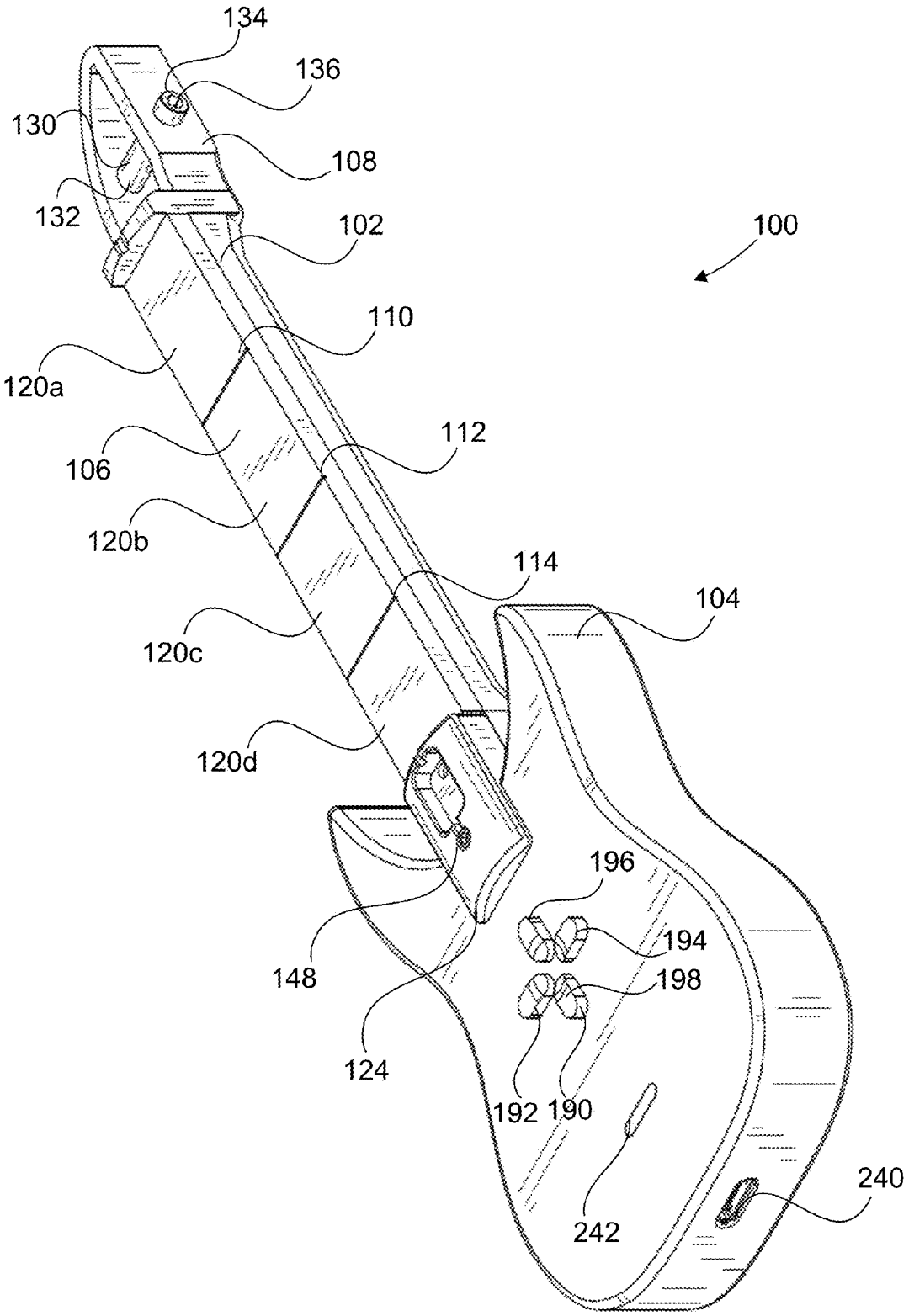
FIG. 1 illustrates an upper perspective view of a micro-practicing device, according to embodiments of the present invention.

In the embodiments shown in FIG. 1, a micro-practicing device 100 includes a neck portion 102 and a body portion 104. The neck portion includes a fingerboard or fretboard 106 and a head 108. The fingerboard 106 includes three fret wires 110, 112, 114 placed on the upper surface 116 of the fingerboard 106 to divide the fingerboard 106 into four frets 120*a*-120*d*. In other embodiments, the fingerboard 106 is divided into more than four frets or less than four frets. Also attached to the neck portion 102 is a bridge saddle 124 and a nut 126, which may be machined from the neck portion 102, such that the nut 126 is unitarily formed with other sections of the neck portion 102. Attached to the head 108 is a tuning machine 130, which includes a barrel 132, a hex end cap 134, and an opposing set or lock screw 136. To adjust the tuning machine 130 (e.g., to increase the tension on a string coupled to the tuning machine 130), the lock screw 136 is loosened, the barrel 132 is rotated to increase the tension on the string, and then the lock screw 136 is tightened to secure the barrel in place.

In the embodiments shown in FIG. 1, there are no strings attached to the neck portion 102 of the micro-practicing device 100. In other embodiments, a string is releasably coupled to the tuning machine 130 and to the bridge saddle 124 and passes over the upper surface 116 of the fretboard 106 and through a notch 138 in the nut 126. In other embodiments, multiple strings are used with multiple tuning machines 130 and with multiple notches 138 in the nut 126.

In some embodiments, the fingerboard 106 is formed of a particular material to emulate a full size instrument. For example, the fingerboard 106 may be made from traditional guitar construction woods such as maple, rosewood, or ebony. In some embodiments, the fingerboard 106 is made from a single piece of wood. In other embodiments, the fingerboard 106 may be constructed, in whole or in part, with plastics, metal, or composite materials. In some embodiments, a bottom surface 139 of the neck portion 102 has a curved surface to form a radius neck, a compound radius neck, or a partial radius or compound radius neck.

Figure 2:
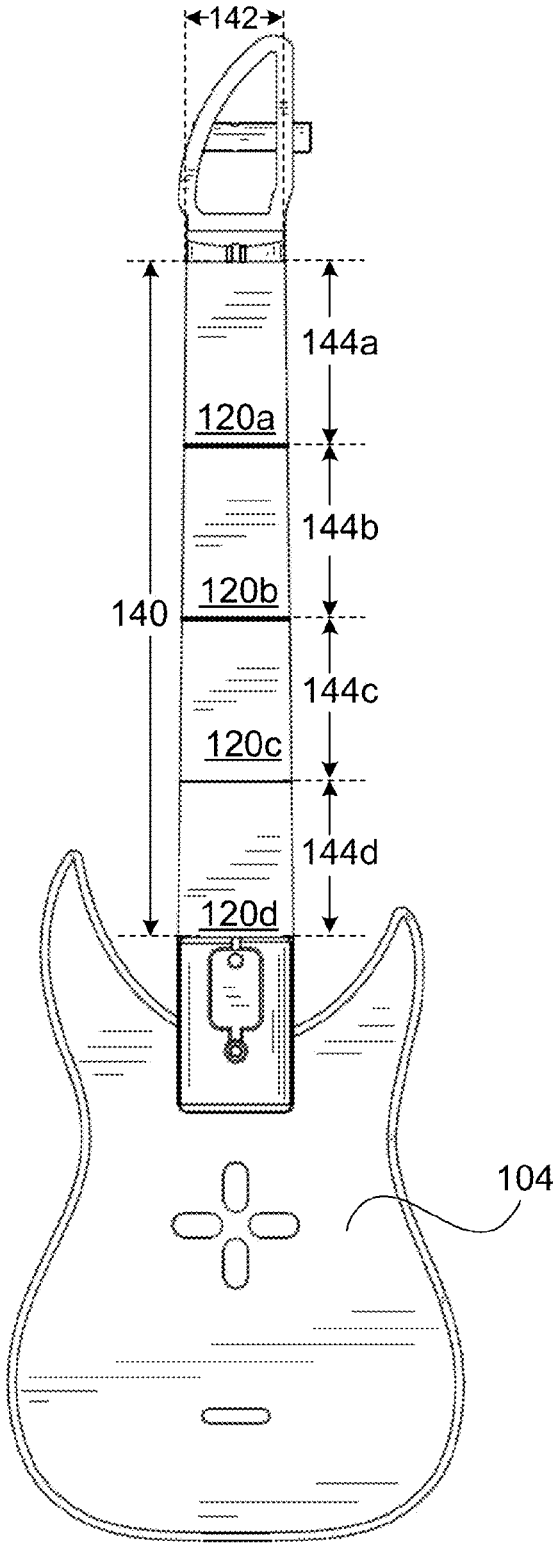
FIG. 2 illustrates a top view of the micro-practicing device of FIG. 1.
Figure 3:
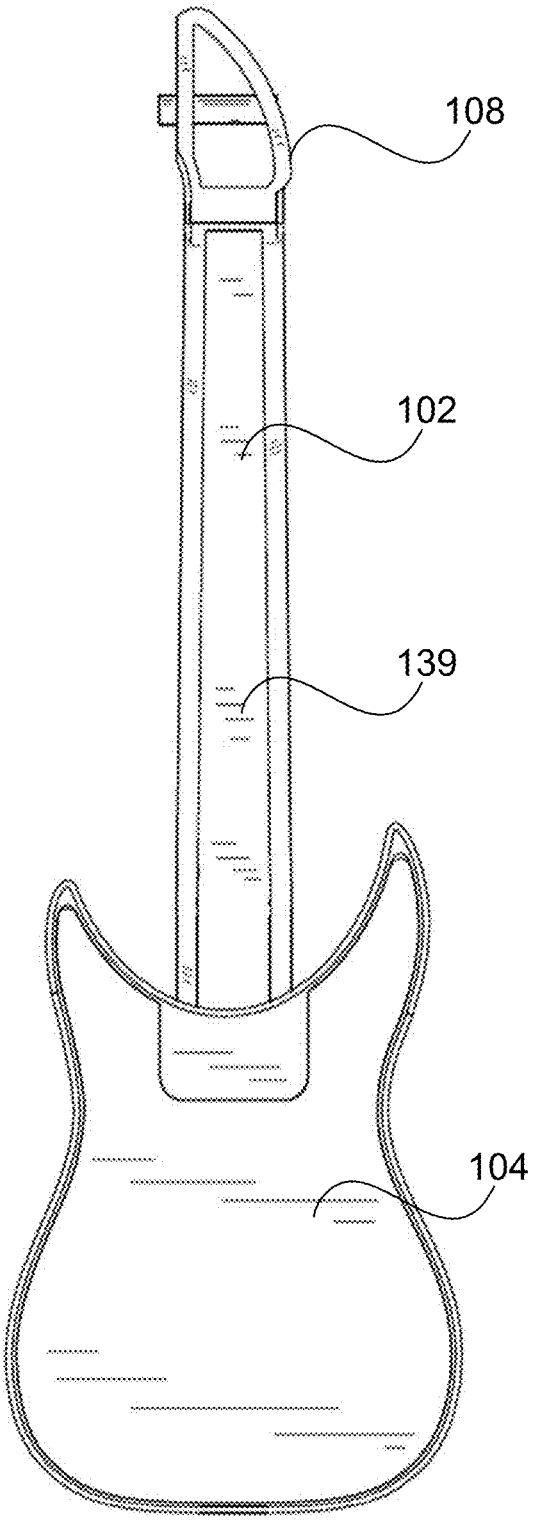
FIG. 3 illustrates a bottom view of the micro-practicing device of FIG. 1.
Figure 4:
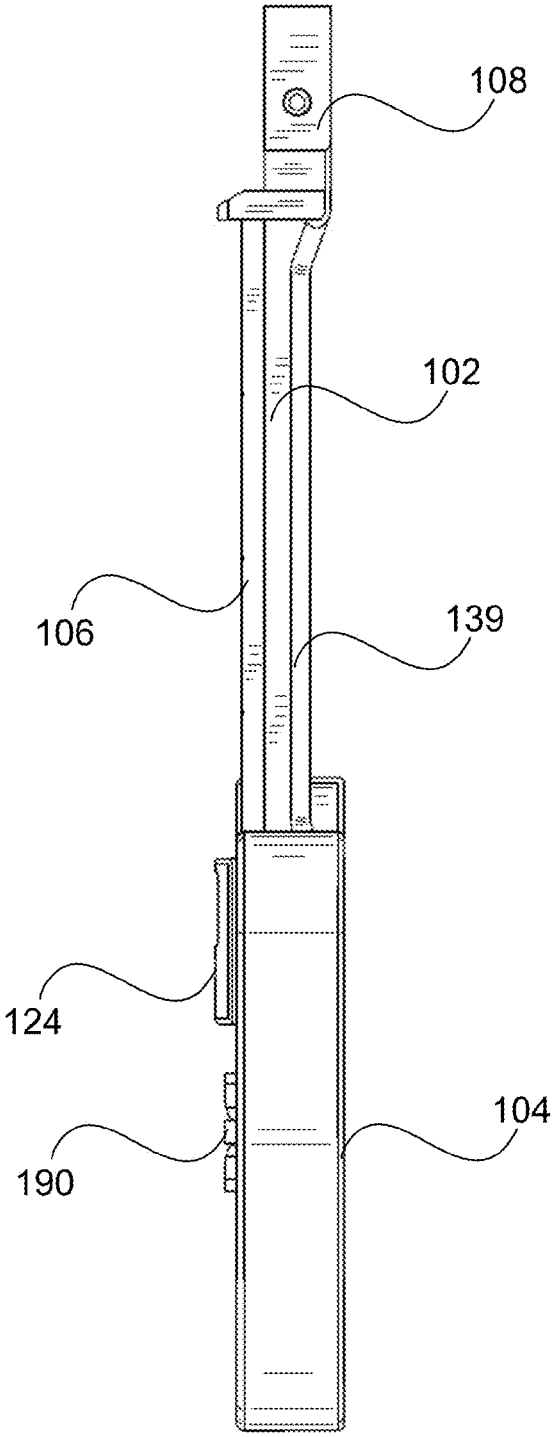
FIG. 4 illustrates a right side view of the micro-practicing device of FIG. 1.
Figure 5:
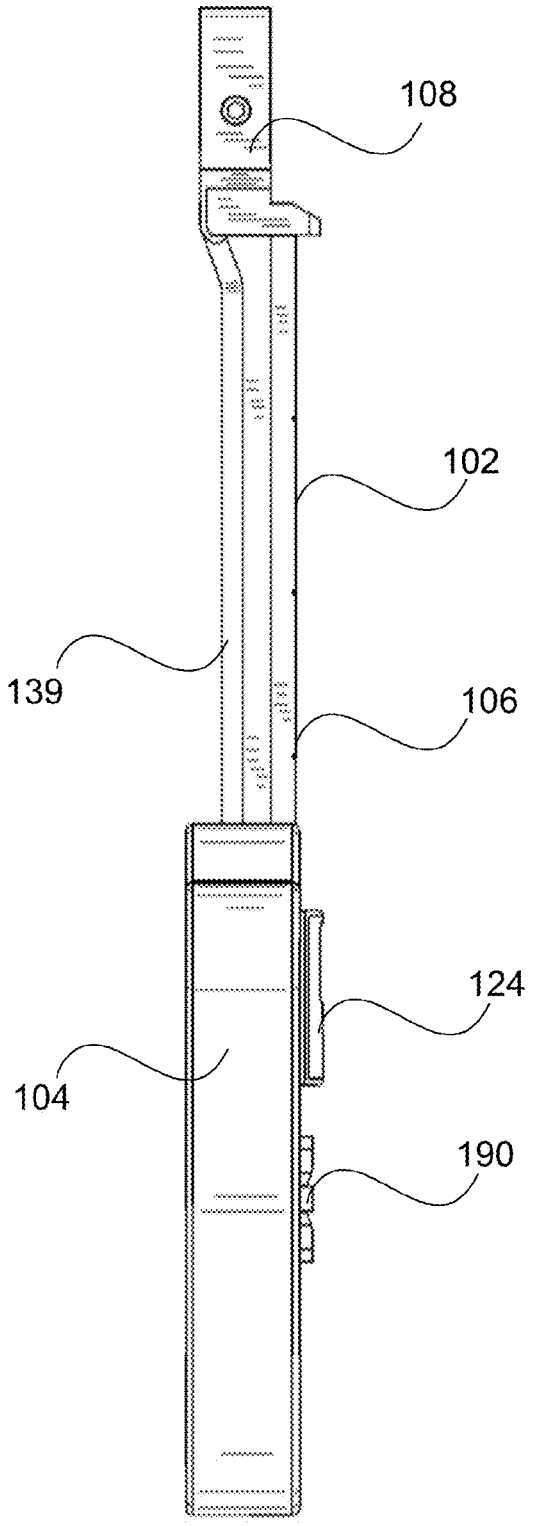
FIG. 5 illustrates a left side view of the micro-practicing device of FIG. 1.
Figure 6:
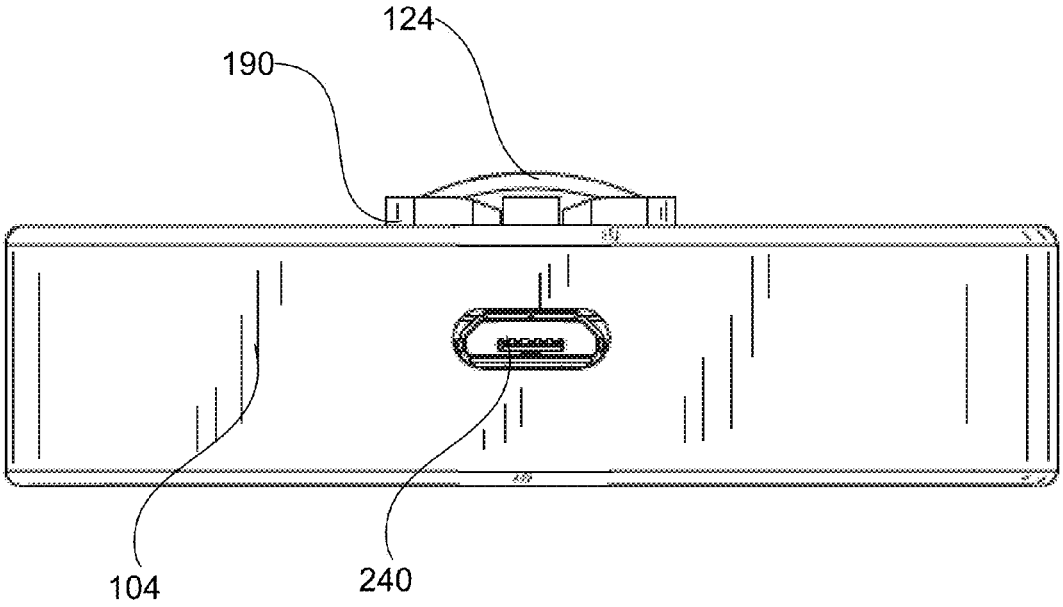
FIG. 6 illustrates a rear view of the micro-practicing device of FIG. 1.
Figure 7:
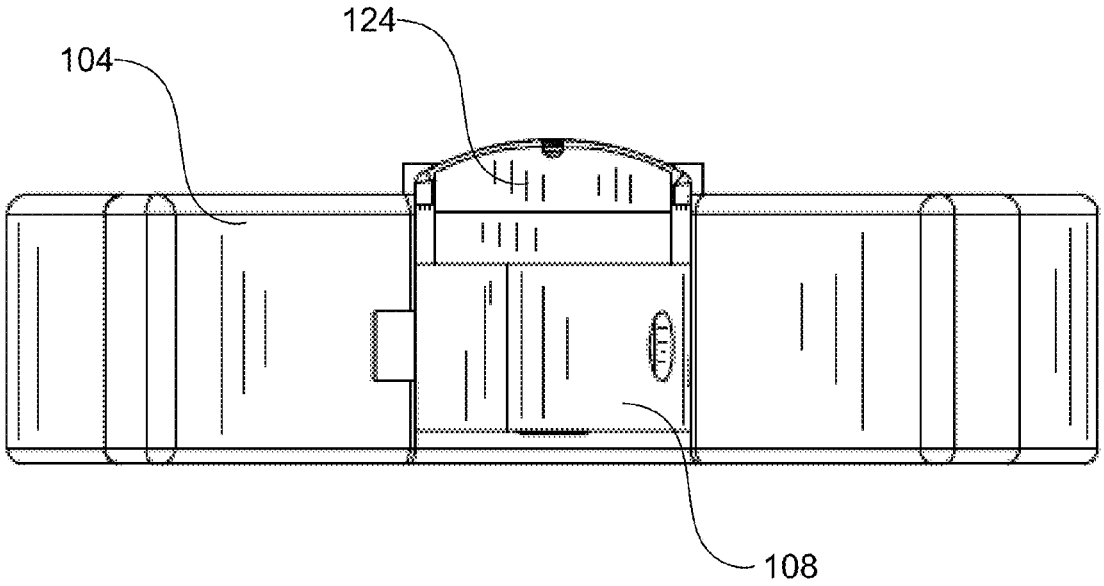
FIG. 7 illustrates a front view of the micro-practicing device of FIG. 1.

As shown in FIG. 2, the fingerboard 106 has a length 140 (e.g., a longitudinal length) and a width 142 (e.g., a lateral or transverse width) that are selected to increase the portability of the micro-practicing device 100 while still enabling authentic practice sessions. For example, a ratio of the length 140 of the fingerboard 106 to the width 142 of the fingerboard 106 may range from 3:1 to 20:1. In other embodiments, that ratio may change, for example, according to the particular instrument emulated, the number of frets on the fingerboard, and/or the number of strings used with the micro-practicing device.

For example, in many full size instruments the spacing between strings, measured from string center to string center, ranges from approximately 0.3 inches to 0.5 inches. Accordingly, in some embodiments the width 142 of the fingerboard 106 will increase by approximately 0.3 inches to 0.5 inches as the number of strings increases. For a specific example, the width 142 of the fingerboard 106 in an embodiment with one string is approximately 0.41 inches. A similar embodiment in which two strings are used will have a larger width 142 for the fingerboard 106, specifically a width 142 of approximately 0.82 inches, and so on. The specific spacing may depend on, for example, the type of instrument being emulated, the gauge of the string, or other such factors. In addition, in some embodiments the fingerboard 106 has a tapered width 142, such that the fingerboard 106 is wider near the bridge 124 than near the nut 126. The degree of tapering may be selected to match the degree of tapering for selected frets (e.g., frets 9-12) on a full-sized instrument.

In some embodiments, the length 140 of the fingerboard 106 is limited, for example, to less than 9 inches or to approximately 6 inches, 4 inches, or less. In other embodiments, the length 140 depends on the number of guitar emulating components such as, for example, the number of frets on the fingerboard 106. Thus, in some embodiments the length 140 ranges from approximately 5 to 6 inches, though greater lengths of approximately 2 to 10 inches may be used. The width of the neck portion may range from 0.2 inches to 4 inches or more.

As shown in FIG. 2, the lengths 144*a*-144*d* of frets 120*a*-120*d* substantially match the lengths of select frets on full-size instruments. For example, in FIG. 2, the lengths 144*a*-144*d* of frets 120*a*-120*d* substantially match the lengths of frets 9-12 on a guitar with a 25.5 inch scale length. In some embodiments, the lengths 144*a*-144*d* of frets 120*a*-120*d* substantially match the lengths of various frets on guitars or other instruments of various lengths. For example, table 1 lists fret lengths for the first 24 frets on a guitar with a 25.5 inch scale length and fret lengths for the first 24 frets on a guitar with a 24.75 inch scale length. The lengths 144*a*-144*d* of frets 120*a*-120*d* may substantially match some of those selected fret lengths. The specific increments of the lengths 140 in the various embodiments may be selected so that the lengths of frets on the fingerboard 106 match lengths of continuous sets of frets on full-size instruments.

TABLE 1

| Fret Number | Fret Length for a 24.75 Inch Scale Length (Inches) | Fret Length for a 25.5 Inch Scale Length (Inches) |
|---|---|---|
| 1 | 1.38911 | 1.43121 |
| 2 | 1.31115 | 1.35088 |
| 3 | 1.23756 | 1.27506 |
| 4 | 1.16810 | 1.20350 |
| 5 | 1.10254 | 1.13595 |
| 6 | 1.04066 | 1.07219 |
| 7 | 0.98225 | 1.01201 |
| 8 | 0.92712 | 0.95521 |
| 9 | 0.87508 | 0.90160 |
| 10 | 0.82597 | 0.85100 |
| 11 | 0.77961 | 0.80324 |
| 12 | 0.73586 | 0.75815 |
| 13 | 0.69456 | 0.71560 |
| 14 | 0.65557 | 0.67544 |
| 15 | 0.61878 | 0.63753 |
| 16 | 0.58405 | 0.60175 |
| 17 | 0.55127 | 0.56797 |
| 18 | 0.52033 | 0.53610 |
| 19 | 0.49112 | 0.50601 |
| 20 | 0.46356 | 0.47761 |
| 21 | 0.43754 | 0.45080 |
| 22 | 0.41299 | 0.42550 |
| 23 | 0.38981 | 0.40162 |
| 24 | 0.36793 | 0.37908 |

In some embodiments, the fret wires (e.g., fret wires 110, 112, 114) are stainless steel fret wires or may be formed from other materials traditionally used in guitar construction. In some embodiments, the gauge of the fret wires is selected to match the gauge of fret wires in full-size guitars, e.g., approximately 0.05 to 0.11 inches.

In some embodiments, the bridge saddle 124 may be formed from an aluminum material. In other embodiments, the bridge saddle is formed from composite materials. As shown in FIG. 1, the bridge saddle 124 secures the string or strings at the bottom of the fingerboard 106. The bridge saddle 124 may include single 0.5 mm set screw (148 in FIG. 1) or multiple set screws to couple and decouple the string or strings 20 to the bridge (e.g., using a hex wrench). The bridge saddle 124 is attached to the fingerboard 106.

The nut 126 in FIG. 1 is a full or partial guitar nut 126 that is used in connection with the string or strings. In some embodiments, the nut 126 is made from graphite, bone, composite materials, or the like. The materials forming the nut 126 may be selected to better emulate a full size instrument. As shown in FIG. 1, the nut 126 includes a notch or notches 138 through which the string or strings are placed. In embodiments in which multiple strings are used, the nut 126 will have a corresponding number of notches 138. The size of each notch 138 is selected based on the gauge of each string. In some embodiments, the gauge of the strings match gauges of full size guitar strings, such that the notches 138 are sized to match those string gauges.

The string or strings may be formed of steel, nylon, or other materials traditionally used with stringed instruments. In order to better emulate full size instruments, the strings have a similar gauge to full size instrument strings, e.g., approximately 0.009 to 0.042 inches. In some embodiments, multiple strings are used. In order to better emulate a full size instrument, the strings may be placed at distances corresponding to distances between strings on full size instruments. For example, a distance between two strings may be from approximately 0.3 inches to 0.5 inches.

Figure 8:
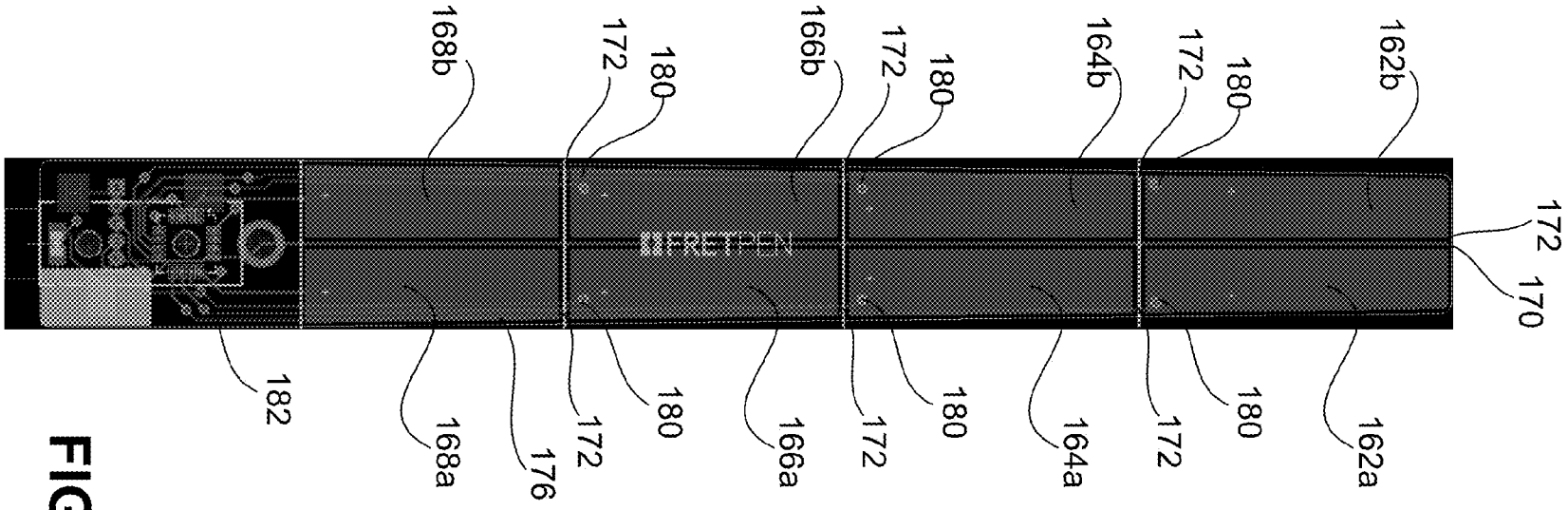
FIG. 8 is a diagram of a neck circuit board, according to embodiments of the present invention.

In some embodiments, the micro-practice device 100 is used to generate positional data that is subsequently converted into musical tones. In particular, the neck portion 102 includes a neck circuit board 160, which is shown in detail in FIG. 8. The neck circuit board 160 is a printed circuit board that includes traces 162*a*, 162*b*, 164*a*, 164*b*, 166*a*, 166*b*, 168*a*, and 168*b* that facilitate capacitive sensing at the frets of the fingerboard 106. One of ordinary skill the art will readily appreciate the materials that could be used to create the trances shown in FIG. 8. The neck circuit board 160 generates electrical signals that indicate the positional location of the user's finger.

In some embodiments, each fret of the neck portion 160 incorporates a plurality of traces below the fingerboard 160 that enable the neck circuit board 160 to generate positional information for both longitudinal (i.e., along the length of the fingerboard 106) and transverse (i.e., along the width of the fingerboard 106) directions. In particular, pairs of traces (e.g., traces 162*a*, 162*b*) are aligned with each fret (e.g., frets 120*a*) in order to detect the position of a user's fingers on the frets. Each trace is transversely separated from its paired fret by a gap 170. Each trace is longitudinally separated from an adjacent fret by a fret spacing 172. The neck circuit board uses the series of traces in order to generate a range of values along the transverse direction for each fret. In some embodiments, these values range from 0-255 with 0 indicating the presence of a finger at the top of the fretboard and 255 indicating the presence of a finger at the bottom of the fretboard. Placing a finger in the middle of the fretboard produces a value of 127. The neck circuit board 160 includes a main power trace 172 that runs down the center of the gap 170. The neck circuit board also includes ground traces 176 that run along the perimeter 178 of the neck circuit board 160. Each ground trace terminates at the beginning of a fret, as shown by the circles 180 in FIG. 8. This configuration enables the neck circuit board 160 to detect and differentiate touches in each fret 'region' or area. In essence that configuration breaks the touch sensitivity up into distinct regions of detection aligned with the frets. As a result, with this configuration different capacitance levels can be read, evaluated and parsed into a fret number (e.g., 1-4 for fretboards with four frets) and position value (0-255) for that fret. As a result, the neck circuit board 160 is able to generate electrical signals that identify the longitudinal and transverse positions of a user's fingers on any number frets simultaneously.

In particular, each trace communicates electrical signals to an integrated circuit 182, which analyzes the signals from each trace to identify the position of a finger. In some embodiments, the integrated circuit 182 compares signals from trace pairs to identify the transverse position of a finger on the fret overlaying that trace pair. Based on that comparison, the integrated circuit 182 assigns a particular value (e.g., from 0-255) for that transverse position.

In some playback modes, simply identifying that the user placed a finger anywhere in a fret is sufficient to generate a data set that can be accurately translated into a particular note or tone. In more advanced cases, the user may want to add common expressions to their play through string bending or other musical techniques. In the embodiment described above, the neck circuit board 160 can detect fingers sliding up or down the fretboard to simulate certain musical techniques. For example, sliding a finger from the center of the fret upwards (i.e., towards the top of the fingerboard) is a common bending technique. The neck circuit board 160 is adapted to detect that finger movement by noting a changing value (e.g., from 127 to 80) in the transverse position. The neck circuit board generates a message identifying that movement, which is sent to an external device for further processing and ultimate translation into the musical expression. Thus, in this embodiment, the neck circuit board 160 identifies a particular value change for a particular fret. In some embodiments, a change of 80 equates to a full bend or a full step. In other embodiments, the amount of change that constitutes a full bend will vary, e.g., from 20 to 120. In some embodiments smaller changes are equated to half bends or half steps (e.g., 40 in one embodiment or any value within a range of 10 to 60 in various embodiments). The neck circuit board 160 identifies that value change as a slide (e.g., a full bend) and consequently conveys that information in its communications with the external device, so that the external device can accurately translate the data into the correct musical expression.

In a similar matter, moving a finger down and off a fretboard is a common 'pull-off' expression. The neck circuit board 160 detects that movement by monitoring the changing values for the fret and generating a corresponding message for the external device, e.g., when the changing values match a predetermined threshold. Those thresholds may be similar to those mentioned above (e.g., a threshold change of 80). The external musical module interprets that message to accurately generate the correct musical expression.

Figure 9:
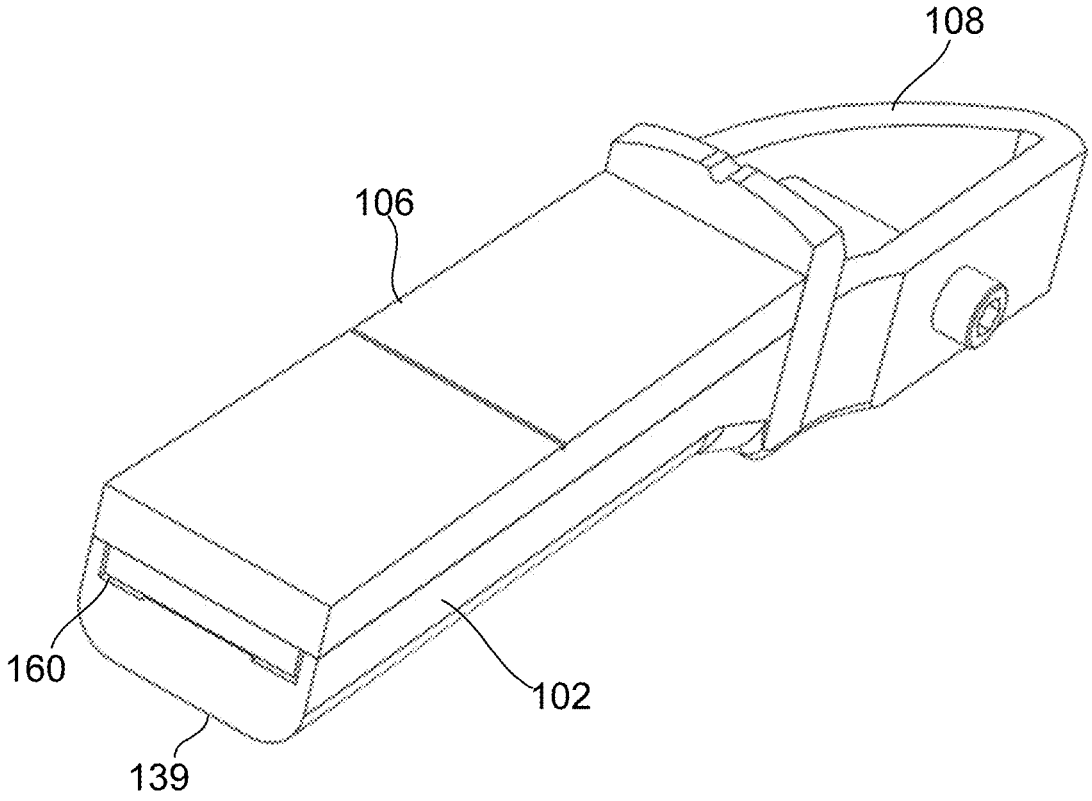
FIG. 9 is a cut-away view of a neck portion, according to embodiments of the present invention.

In some embodiments, the fingerboard 160 is made of solid materials, like wood, in order to create a more authentic playing experience. While these materials provide a more authentic playing experience, these materials could negatively impact the sensitivity of the neck circuit board 160. For example, FIG. 9 illustrates a cross-sectional view of the neck portion 106 to demonstrate how the fingerboard 160 overlays the neck circuit board 160. In some embodiments, the fingerboard 160 could be 3 mm thick.

In those embodiments, the power delivered to the neck circuit board 160 and/or the signals generated by the neck circuit board 160 are amplified so that the user's fingers can be precisely detected. Thus, the device amplifies the signal in the neck circuit board 160 to facilitate detection through solid, non-capacitive materials (like wood). This enables the micro-practicing device 100 to accurately generate the electrical signals without requiring flexible, pressure sensitive materials, vibration detecting films, or capacitive materials on or in the fretboard 106.

The body portion 104, in some embodiments, includes a power source as well as communications modules to facilitate the transmission of signals from the neck circuit board 160 to an external musical module. As shown in FIG. 1, the body portion also includes a directional pad 190. In some embodiments, the directional pad 190 simulates a larger playing experience. In particular, in some embodiments, movement of the directional pad creates signals that cause the external musical module to play musical notes on different strings and on different frets. For example, pressing the up and down portions (192 and 194, respectively) of the directional pad 190 creates the effect of moving up and down strings on a guitar, while pressing the left and right portions (196 and 198, respectively) of the directional pad 190 creates the effect of moving up and down frets on the guitar. Thus, actuating the directional pad 190 sends a message to the external module that is used to increment or decrement the note number to be played.

Figure 10:
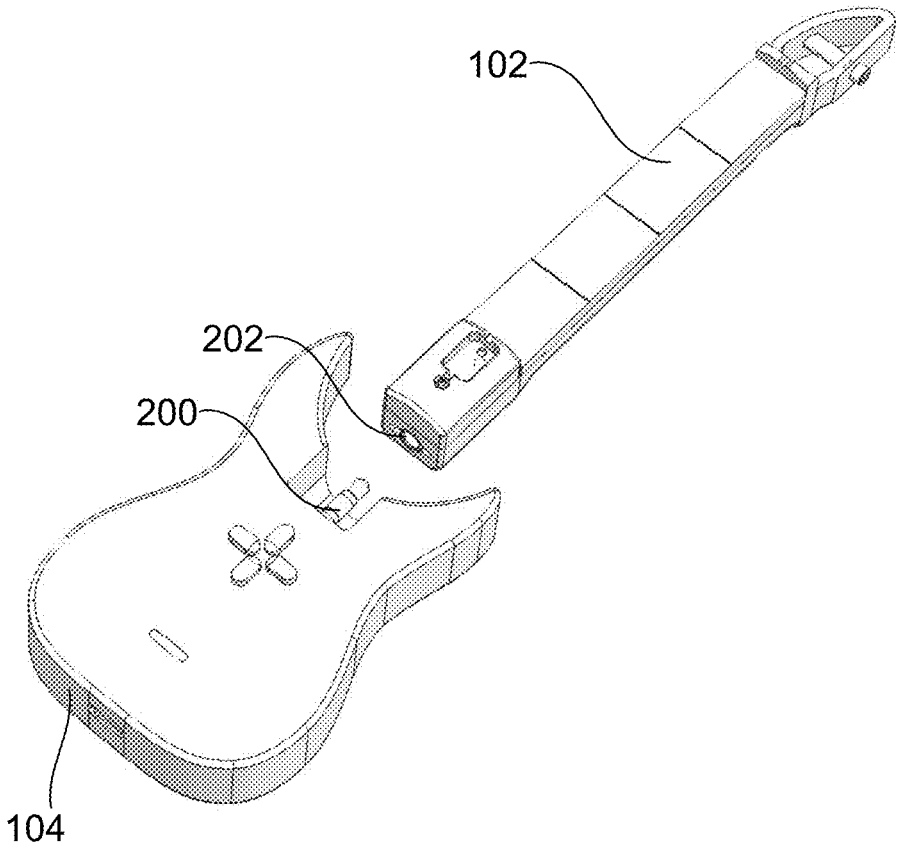
FIG. 10 illustrates the separation of a neck portion from a body portion, according to embodiments of the present invention.
Figure 11:
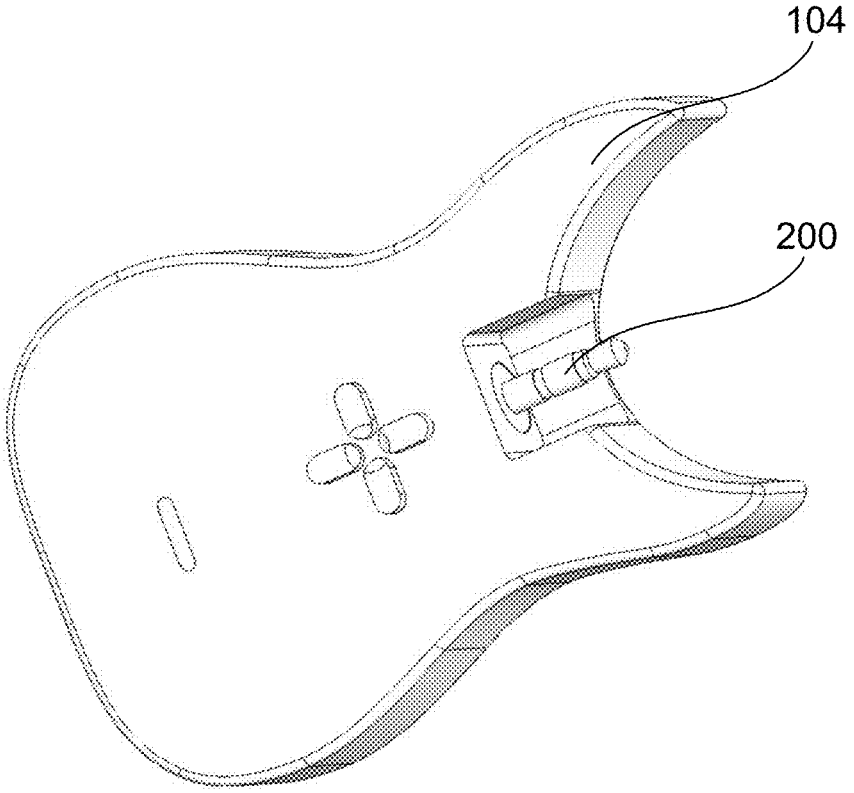
FIG. 11 illustrates a perspective view of a body portion, according to embodiments of the present invention.

As shown in FIG. 10, the neck portion 102 is removeably coupled to the body portion 104. Specifically, in some embodiments the body portion 104 includes a male coupler 200 and the neck portion 102 includes a corresponding female coupler 202. In other embodiments the body portion 104 includes the female coupler 202 while the neck portion 102 includes the male coupler 200. The male coupler 200 in FIG. 10 is a 3.5 mm TRS (Tip-Ring-Sleeve) audio connector, which is a connector frequently associated with musical devices. The female coupler 202 is a 3.5 mm receptacle. The resulting electronic interface between the neck portion 102 and the body portion 104 delivers power and facilitates communications required for the operation of the device 100. A total of three connections (voltage, ground, and data) are required and facilitated by the 3.5 mm TRS audio connector and receptacle. Voltage (i.e., power) and ground are transferred from the body portion 104 to the neck portion 102 while data is transmitted from the neck portion 102 back to the body portion 104 using the TRS interface. The data represents capacitive touch values gathered from sensing via the neck circuit board 160 located below the fretboard 106.

Figure 12:
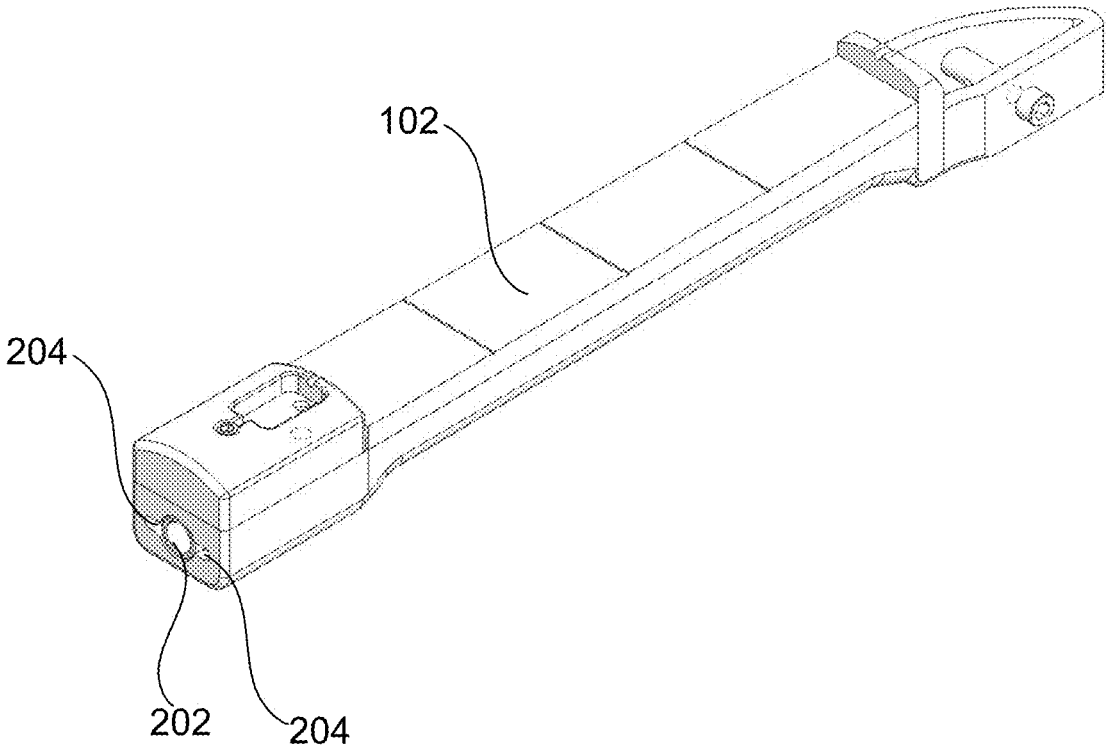
FIG. 12 illustrates a perspective view of a neck portion, according to embodiments of the present invention.
Figure 13:
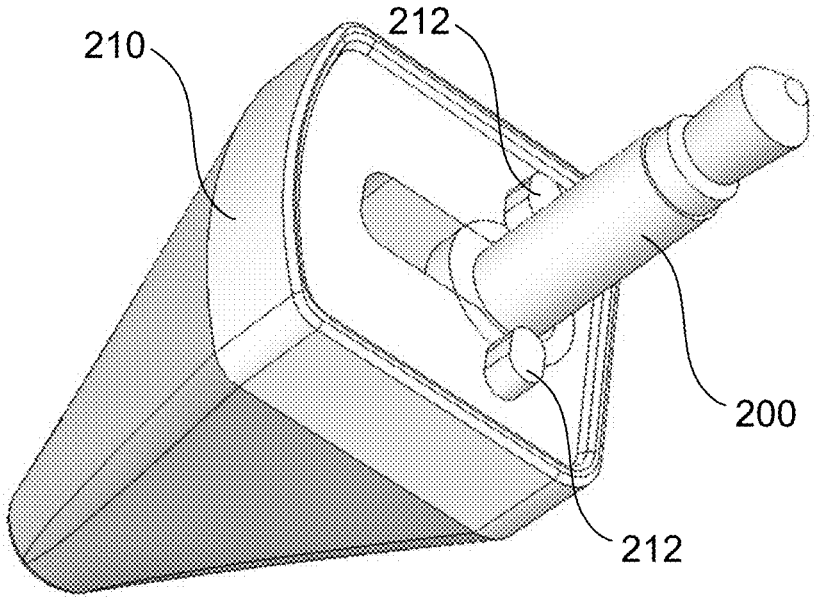
FIG. 13 illustrates a perspective view of an accessory, according to embodiments of the present invention.
Figure 14:
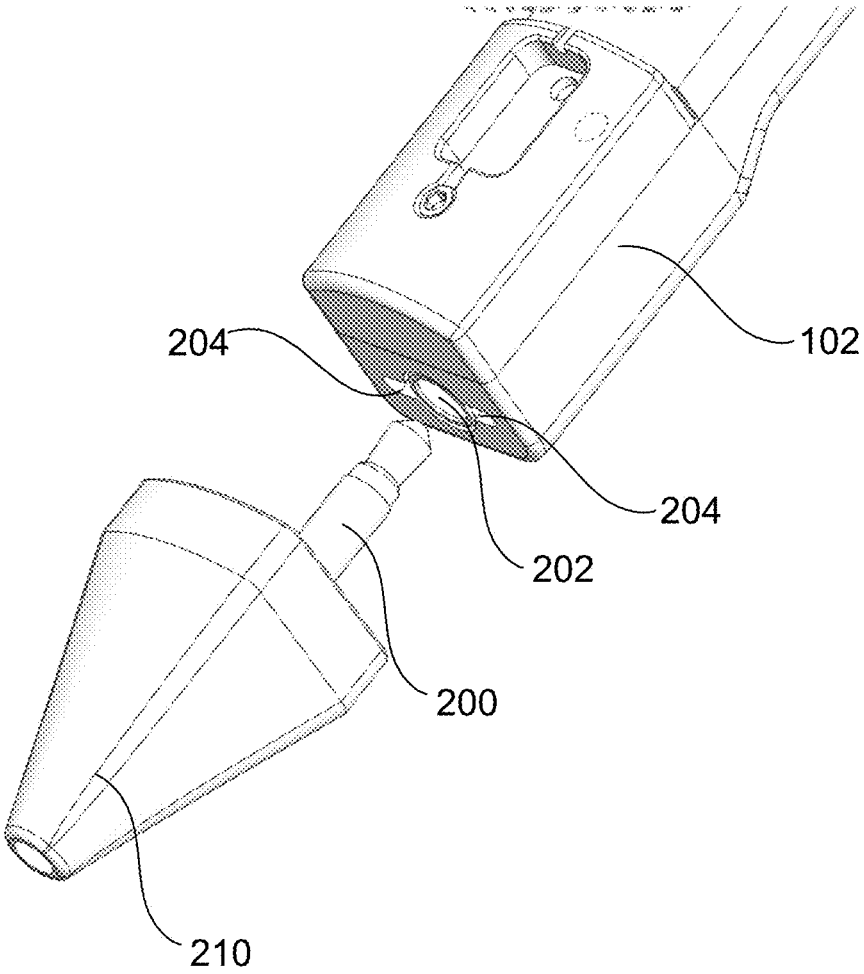
FIGS. 14-17 illustrate an accessory as it couples with a neck portion, according to embodiments of the present invention.
Figure 15:
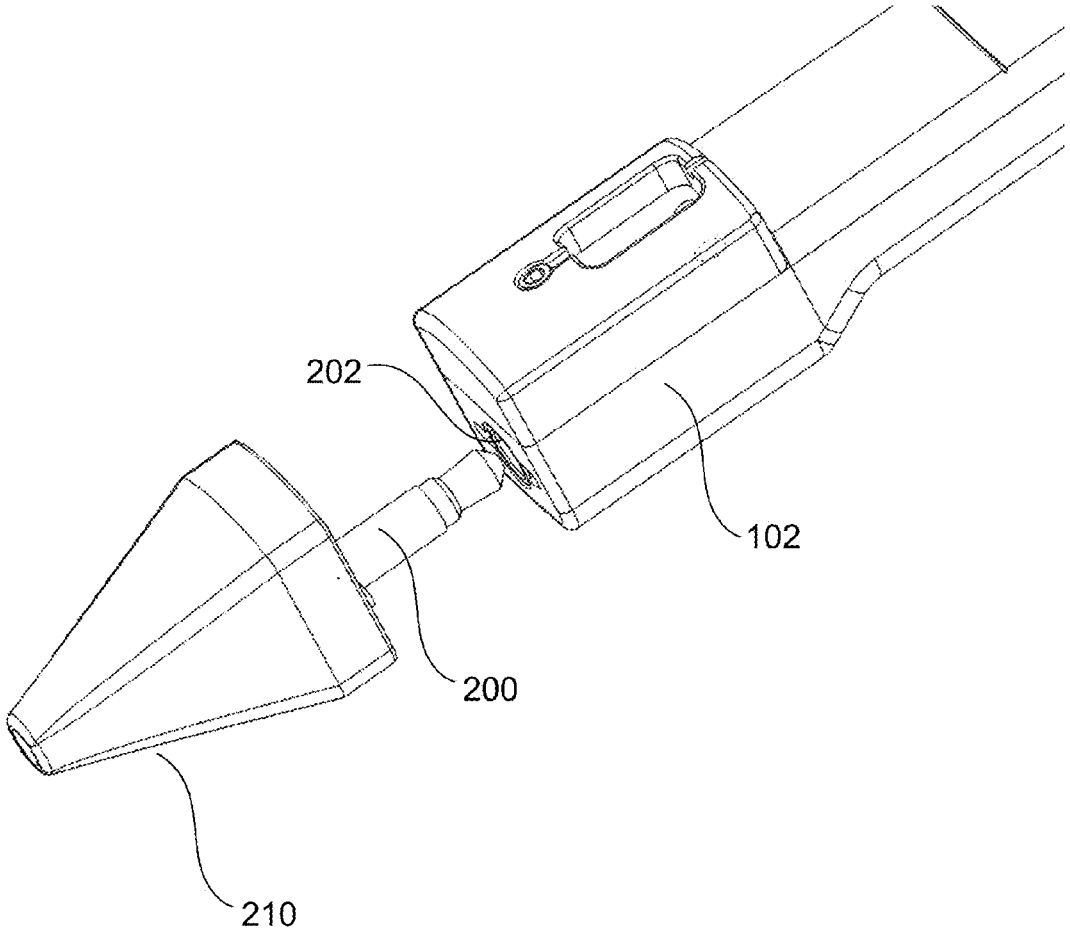
Figure 16:
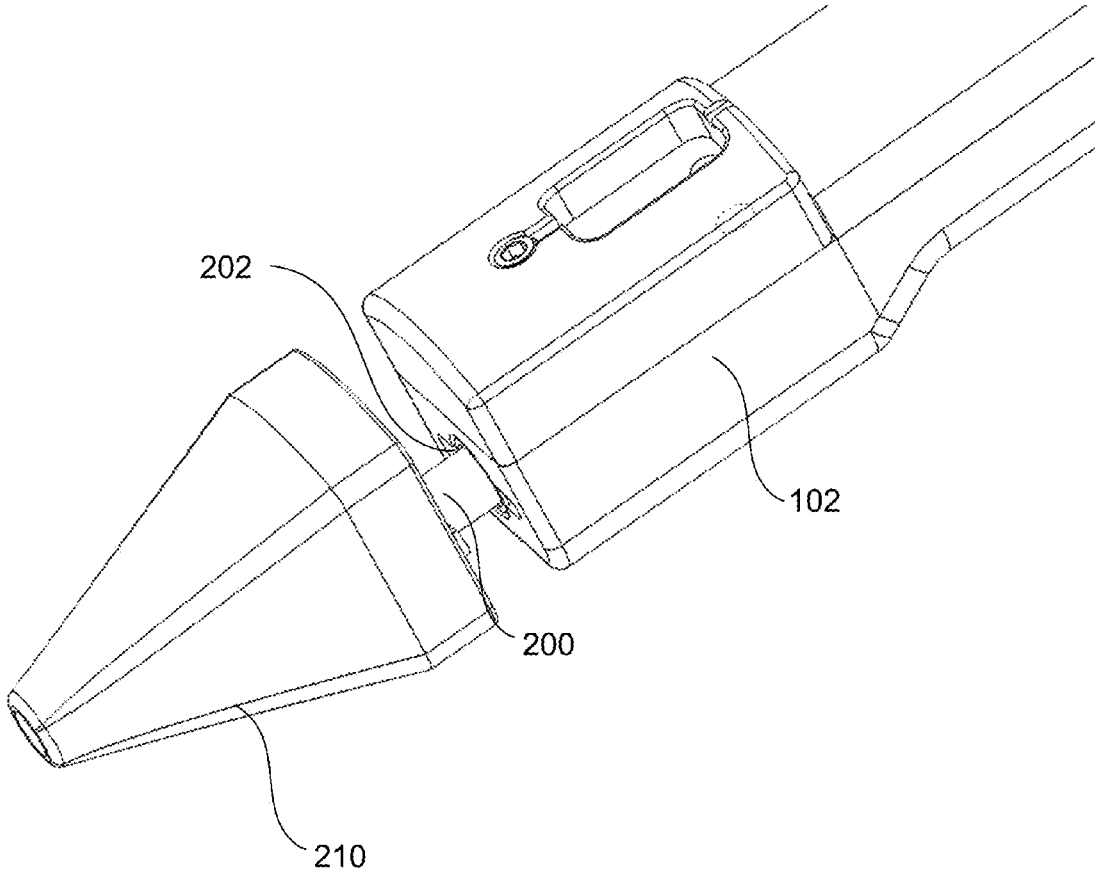

As shown in FIGS. 10 and 12, the connecting end of the neck portion 102 (i.e., near the female jack or receptacle 202) is outfitted with alignment notches 204 to ensure a functional and complete connection to an accessory. An exemplary accessory 210 is shown in FIG. 13. The accessory 200 is outfitted with small tabs 212 that line up with and resolve into the notches 204 in the neck portion 102. This keyed system supports proper alignment between the neck portion 102 and the accessory 200, prevents rotation, and also protects the neck electronics from the elements. In some embodiments, the notches 204 and the tabs 212 are different shapes to ensure coupling in only a single orientation. The accessory 210 also includes a male coupler 200 (e.g., a 3.5 mm TRS (Tip-Ring-Sleeve) audio connector) to couple with the female receptor 202 of the neck portion 102. In other embodiments, the accessory 210 includes a female receptor 202 configured to receive a male coupler 200 of the neck portion 102. The specifics of the accessory 210 can vary widely—the accessory 210 in FIG. 13 incorporates a pen cartridge, while other accessories can incorporate a variety of features and assume a variety of shapes. For example, some accessories incorporate a mechanical pencil, a tablet stylus (e.g., a resistive or a capacitive tablet stylus), an LED light, or a laser. Other accessories 210 emulate other handheld items, like a spoon.

Figure 17:
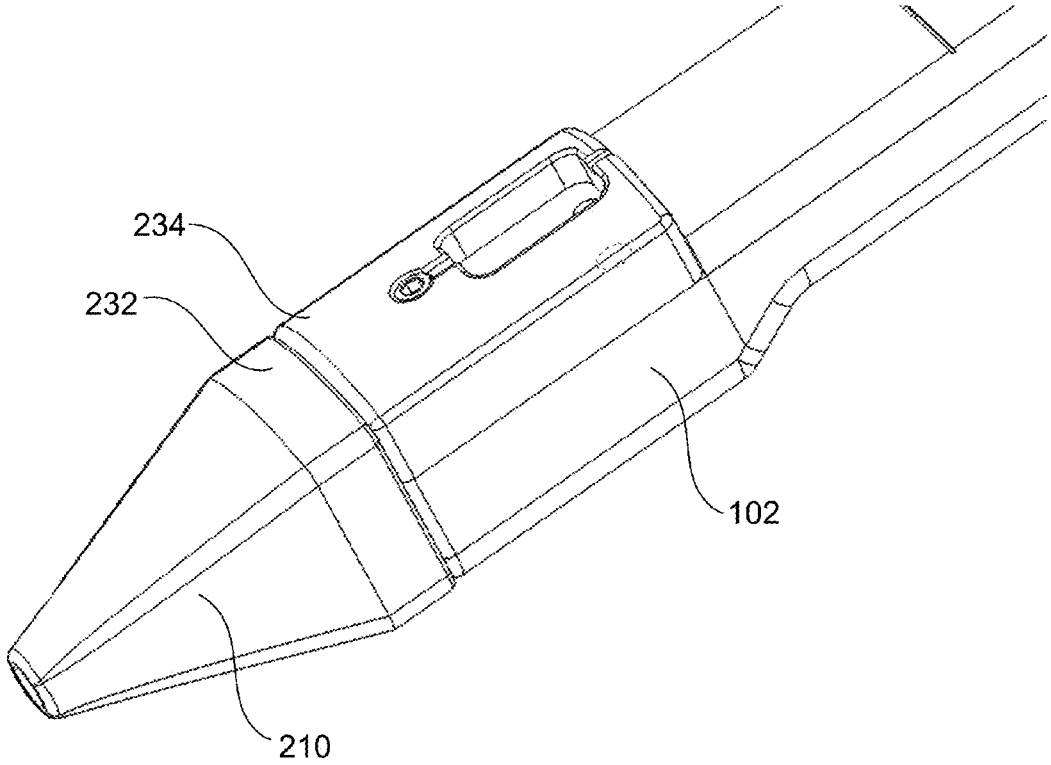

FIGS. 14-17 illustrate the accessory 210 as it couples with the neck portion 102. As shown in FIG. 17, the width 230 of the accessory 210 at the coupling end 232 substantially matches the width of the neck portion 102 at its coupling end 234 to ensure a uniform fit.

As discussed above, the neck portion 102 generates data regarding the position of the user's fingers on the frets, which it communicates to the body portion 104. The body portion 104, in some embodiments, is configured to transmit that data to an external musical module, either over a wired connection or a wireless connection. The external musical model converts that data to musical tones. The data derived from capacitive touch events is packaged in small messages of less than eight bytes. Each small message identifies a particular fret as well as the transverse position of a finger on that fret. The use of small messages enables very fast transmission times since no additional processing to convert the data to musical tones are being performed by the device. These small messages may be sent wirelessly to a paired mobile device for further processing, which could include conversion to musical tones, MIDI messages, interpreting slides, translating octaves, etc., among others. A highly efficient, short range wireless technology like Bluetooth LE may be used due to its simplistic configuration, security, and ubiquity. Because the maximum sample size on a four-fret device is four messages, which are each less than eight bits, the resulting dataset is naturally very small, portable and communicated quickly. Thus, the focused nature of the micro-practicing device 200 is particularly amenable to the BTLE protocol. Specifically, for embodiments using less than six strings, the micro-practicing device 100 creates a smaller set of signals that are sent to the body portion 104. As a result, the smaller transmission capacity of the BTLE protocol does not become overwhelmed with data, and the musical processing device can create the musical tones from the micro-practicing device 100 without unnecessary delay that could occur, for example, if BTLE protocol were used with a six stringed device and its larger signal set. This allows for a very low-latency playback experience, which is especially desirable in creating music.

In some embodiments, the body portion 104 includes a signal pre-processor that provides tone information to the external musical module. For example, the body portion 104 may be shaped like an acoustic guitar and provide a signal pre-processor that provides tone information so that the external musical module emits an acoustic tone. Similarly, an electric guitar-shaped body portion 104 includes a pre-processor that causes the external music module to emit a distorted tone. In other embodiments, the signal processing or tone selection could be selectively implemented on the external musical module.

The body portion 104 may also include an onboard Micro USB port (240 in FIG. 1) or similar interface for charging the battery and performing firmware updates. As also shown in FIG. 1, the body portion 104 includes a light 242 that conveys status information.

As mentioned above, in some embodiments, the external module receives data from the body portion 104 over a wired or a wireless connection. For the wired connection, in some embodiments, the body portion 104 includes an output jack. The signals from the neck circuit board 160 are transmitted to the output jack, along with any additional data generated by, e.g., the directional pad. In some embodiments, the output jack is a ⅛ inch (3.5 mm) stereo jack. In those embodiments, the electric signals from the output jack are sent to audio-enabled devices to emit the musical tones created on the micro-practicing device 100. For example, a ⅛ inch male to ¼ inch male stereo cable could be used to plug the micro-practicing device 100 (using, e.g., the output jack) into an external musical module (e.g., via an interface device such as iRig or the like). The external musical module may be incorporated into devices such as smart phones, tablets, laptops, or other processing devices with appropriate software. In those examples, the external musical module interprets the inbound signals from the micro-practicing device 100, adjusts the signals using system and user-defined settings, and emits an audible tone through speakers or headphones. Because the length of the frets (e.g., lengths 144*a*-144*d* of frets 120*a*-120*d*) may substantially correspond to lengths of frets on full size instruments, the musical tones created by the micro-practicing device 100 may correspond to musical tones created by full size instruments.

In some embodiments, the received data includes messages from the neck circuit board 160 as well as information from the directional pad. The external module interprets that data to produce a corresponding note or notes. In some embodiments, the external module is integrated into a smartphone or into a portable speaker system. The external module is also able to modify the note or notes using system and user-defined settings.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A hand-held micro-practicing device for emulating a portion of a full size instrument having a plurality of strings and a plurality of frets, the device comprising:

a body portion;

a fingerboard configured to operate in a stationary position relative to the body portion, the fingerboard being adapted to emulate only a subset of the plurality of frets of the full size instrument;

a plurality of capacitive sensors adapted to generate positional signals indicative of a position of a user's finger with respect to the emulated frets;

a fret selector adapted to select which frets of the plurality of frets of the full size instrument are included in the subset of frets and to generate fret data indicating that selection; and a processor adapted to receive the positional signals and the fret data and to translate the positional signals and the fret data into musical information.

2. The hand-held micro-practicing device of claim 1, wherein the fret selector is a human operable fret selector adapted to create fret selection data that are used by the processor to create an effect of moving up or down the plurality of frets of the full size instrument by incorporating one or more frets previously outside the subset of the plurality of frets into the subset of the plurality of frets.

3. The hand-held micro-practicing device of claim 1, wherein the fret selector is adapted to generate dynamic fret data indicating a change to the selection of which frets of the plurality of frets of the full size instrument are included in the subset of frets.

4. The hand-held micro-practicing device of claim 1, wherein the plurality of capacitive sensors are adapted to generate positional signals indicative of a longitudinal position and a transverse position of the user's finger with respect to the emulated frets.

5. The hand-held micro-practicing device of claim 4, wherein the processor is adapted to identify a bending technique by detecting a change in the transverse position of the user's finger with respect to the emulated frets and to incorporate the bending technique into the musical information.

6. The hand-held micro-practicing device of claim 5, wherein the processor is adapted to identify the change in the transverse position of the user's finger with respect to the emulated frets as a half bend technique or a full bend technique by comparing that change to a set of predefined change values.

7. A micro-practicing system configured to simulate a playing experience of a full size instrument having a plurality of strings that range from a lowest string to a highest string and a plurality of frets, the micro-practicing device comprising:

a fingerboard adapted to emulate only a subset of the plurality of frets and to emulate only a subset of the plurality of strings;

capacitive circuitry adapted to detect one or more longitudinal positions of one or more fingers with respect to the fingerboard, to detect one or more transverse positions of the one or more fingers with respect to the fingerboard, and to transmit electrical signals indicative of the one or more longitudinal positions and the one or more transverse positions of the fingers;

a string selector adapted to select which string or strings of the plurality of strings are included in the subset of the plurality of strings; and a processor adapted to receive the electrical signals from the capacitive circuitry and to use the electrical signals from the capacitive circuitry to generate musical information that corresponds to the selected string or strings of the full size instrument.

8. The micro-practicing system of claim 7, wherein the string selector is a human operable string selector.

9. The micro-practicing system of claim 7, wherein the capacitive circuitry includes means for detecting a transverse position of a finger with respect to the fingerboard within a range of detectable transverse positions spanning a single emulated fret.

10. The micro-practicing system of claim 9, wherein the range of detectable transverse positions includes 256 detectable transverse positions spanning the single emulated fret.

11. The micro-practicing system of claim 7, further comprising a communications module adapted to communicate the electrical signals from the capacitive circuitry to the processor.

12. The micro-practicing system of claim 11, wherein the communications module includes a 3.5 mm TRS audio connector adapted to electrically connect to the capacitive circuitry.

13. The micro-practicing system of claim 7, wherein the fingerboard is formed of a non-conducting material and the capacitive circuitry is located below an exterior-facing surface of the fingerboard.

14. A hand-held device for emulating a portion of a full size musical instrument having a plurality of strings, the device comprising:

a fingerboard adapted to emulate only a portion of the full size musical instrument by simulating only a subset of the plurality of strings;

capacitive circuitry adapted to generate positional signals indicative of a position of a user's finger with respect to frets of the fingerboard;

a string selector adapted to change which string or strings of the plurality of strings are included in the subset of the plurality of strings and to generate string data representing which string or strings are included in the subset of the plurality of strings; and a processor adapted to convert the positional signals from the capacitive circuitry and the string data from the string selector into musical information.

15. The hand-held device of claim 14, wherein the capacitive circuitry includes at least one trace pair.

16. The hand-held device of claim 15, wherein the at least one trace pair is adapted to produce signals indicative of a transverse position of the user's finger within a fret of the fingerboard.

17. The hand-held device of claim 16, wherein the processor is configured to identify a change in the transverse position of the user's finger and to determine whether that change reflects a bending technique.

18. The hand-held device of claim 16, wherein the processor is configured to identify a change in the transverse position of the user's finger and to determine whether that change reflects a full bend or a half bend using predetermined thresholds for the full bend and the half bend.

19. The hand-held device of claim 15, wherein a first trace of the at least one trace pair is separated from a second trace of the at least one trace pair by a gap.

20. The hand-held device of claim 14, wherein the processor is configured to identify a change in the position of the user's finger and to determine whether that change reflects a pull-off expression using a predetermined threshold.

* * * * *